US008841588B2

(12) United States Patent
Liu et al.

(10) Patent No.: US 8,841,588 B2
(45) Date of Patent: Sep. 23, 2014

(54) HEATER

(75) Inventors: Peng Liu, Beijing (CN); Liang Liu, Beijing (CN); Kai-Li Jiang, Beijing (CN); Shou-Shan Fan, Beijing (CN)

(73) Assignees: Tsinghua University, Beijing (CN); Hon Hai Precision Industry Co., Ltd., New Taipei (TW)

( * ) Notice: Subject to any disclaimer, the term of this patent is extended or adjusted under 35 U.S.C. 154(b) by 401 days.

(21) Appl. No.: 12/589,828

(22) Filed: Oct. 29, 2009

(65) Prior Publication Data

US 2010/0243637 A1 Sep. 30, 2010

(30) Foreign Application Priority Data

Mar. 27, 2009 (CN) ..... 2009 1 0106403

(51) Int. Cl.
*H05B 3/06* (2006.01)
*H05B 3/14* (2006.01)

(52) U.S. Cl.
CPC ..... *H05B 3/145* (2013.01); *H05B 2203/032* (2013.01); *H05B 2214/04* (2013.01)
USPC ..... 219/520; 219/529; 219/546

(58) Field of Classification Search
USPC ..... 219/520, 538, 539, 542–548, 443.1, 219/441.1, 552, 553, 541, 519, 549; 338/306, 307–309, 322, 323, 324, 325, 338/331, 332; 313/313, 311, 495–497; 445/49–51; 359/240, 242, 245, 247, 359/253, 254, 315, 318, 321, 265–277, 359/288; 345/49, 105, 817
See application file for complete search history.

(56) References Cited

U.S. PATENT DOCUMENTS

| | | | |
|---|---|---|---|
| 1,710,512 | A | 4/1929 | Pitt et al. |
| 5,698,175 | A | 12/1997 | Hiura et al. |
| 5,788,853 | A | 8/1998 | Zenhausern |
| 5,958,358 | A | 9/1999 | Tenne et al. |
| 6,863,942 | B2 | 3/2005 | Ren et al. |

(Continued)

FOREIGN PATENT DOCUMENTS

| | | |
|---|---|---|
| CN | 1066934 | 12/1992 |
| CN | 2277273 Y | 4/1998 |

(Continued)

OTHER PUBLICATIONS

Zhang et al., "Formation of metal nanowires on suspended single-walled carbon nanotubes", Applied physics letters vol. 77, No. 19. Nov. 2000.

(Continued)

*Primary Examiner* — Cuong Q Nguyen
*Assistant Examiner* — Yosef Gebreyesus
(74) *Attorney, Agent, or Firm* — Novak Druce Connolly Bove + Quigg LLP

(57) ABSTRACT

A heater includes a substrate, a plurality of first electrode down-leads, a plurality of second electrode down-leads and a plurality of heating units. The plurality of first electrode down-leads are located on the substrate in parallel to each other and the plurality of second electrode down-leads are located on the substrate in parallel to each other. The first electrode down-leads cross the second electrode down-leads and define a plurality of grids. One heating unit is located in each grid. Each heating unit includes a first electrode, a second electrode and a heating element. The heating element includes a carbon nanotube structure.

16 Claims, 14 Drawing Sheets

(56) References Cited

U.S. PATENT DOCUMENTS

| | | | | |
|---|---|---|---|---|
| 7,045,108 | B2 | 5/2006 | Jiang et al. | |
| 7,077,939 | B1 | 7/2006 | Crooks et al. | |
| 7,166,266 | B2 | 1/2007 | Nikolaev et al. | |
| 7,355,216 | B2 | 4/2008 | Yang et al. | |
| 7,569,850 | B2 | 8/2009 | Noy et al. | |
| 7,704,480 | B2 | 4/2010 | Jiang et al. | |
| 7,750,297 | B1 | 7/2010 | Chow et al. | |
| 2003/0185741 | A1 | 10/2003 | Matyjaszewski et al. | |
| 2004/0034177 | A1 | 2/2004 | Chen | |
| 2004/0053780 | A1 | 3/2004 | Jiang et al. | |
| 2004/0144970 | A1 | 7/2004 | Wang et al. | |
| 2005/0007002 | A1* | 1/2005 | Golovchenko et al. | 313/311 |
| 2005/0040371 | A1* | 2/2005 | Watanabe et al. | 252/500 |
| 2005/0208304 | A1 | 9/2005 | Collier et al. | |
| 2005/0252906 | A1 | 11/2005 | Shaw et al. | |
| 2006/0169975 | A1 | 8/2006 | Noy et al. | |
| 2006/0204428 | A1 | 9/2006 | Noy et al. | |
| 2006/0275956 | A1 | 12/2006 | Konesky | |
| 2007/0128707 | A1 | 6/2007 | Rorrer et al. | |
| 2007/0137786 | A1 | 6/2007 | Luzzi | |
| 2007/0142559 | A1 | 6/2007 | Wang et al. | |
| 2007/0284987 | A1* | 12/2007 | Liu et al. | 313/311 |
| 2007/0295714 | A1 | 12/2007 | Liu et al. | |
| 2008/0170982 | A1* | 7/2008 | Zhang et al. | 423/447.3 |
| 2008/0187648 | A1 | 8/2008 | Hart et al. | |
| 2008/0227360 | A1* | 9/2008 | Liu et al. | 445/46 |
| 2008/0237464 | A1 | 10/2008 | Zhang et al. | |
| 2008/0251274 | A1 | 10/2008 | Lee et al. | |
| 2008/0261276 | A1* | 10/2008 | Ponjee et al. | 435/91.2 |
| 2009/0085461 | A1 | 4/2009 | Feng et al. | |
| 2009/0096346 | A1 | 4/2009 | Liu et al. | |
| 2009/0096348 | A1 | 4/2009 | Liu et al. | |
| 2009/0324811 | A1* | 12/2009 | Jung | 427/113 |
| 2010/0203316 | A1 | 8/2010 | Hata et al. | |

FOREIGN PATENT DOCUMENTS

| | | | |
|---|---|---|---|
| CN | 2419303 | Y | 2/2001 |
| CN | 2462823 | | 12/2001 |
| CN | 1483667 | | 3/2004 |
| CN | 1549654 | A | 11/2004 |
| CN | 2696260 | Y | 4/2005 |
| CN | 1731897 | | 2/2006 |
| CN | 2768365 | | 3/2006 |
| CN | 2826228 | Y | 10/2006 |
| CN | ZL 200620003832 | | 4/2007 |
| CN | 1982209 | | 6/2007 |
| CN | 101014218 | | 8/2007 |
| CN | 101090586 | | 12/2007 |
| CN | 201014632 | Y | 1/2008 |
| CN | 101212848 | | 7/2008 |
| CN | 101217097 | | 7/2008 |
| CN | 101276724 | | 10/2008 |
| CN | 101400198 | | 4/2009 |
| CN | 101409961 | | 4/2009 |
| CN | 101409962 | | 4/2009 |
| EP | 2043406 | A2 | 1/2009 |
| EP | 2043406 | | 4/2009 |
| JP | 3-295041 | | 12/1991 |
| JP | 5-144554 | | 6/1993 |
| JP | 7-103498 | | 4/1995 |
| JP | 8-87 | | 1/1996 |
| JP | 2000-195470 | | 7/2000 |
| JP | 2000-306810 | | 11/2000 |
| JP | 2003-130376 | | 5/2003 |
| JP | 2004-234905 | | 8/2004 |
| JP | 2005249414 | | 9/2005 |
| JP | 2006-147286 | | 6/2006 |
| JP | 2006-222100 | | 8/2006 |
| JP | 2006244742 | | 9/2006 |
| JP | 2008523254 | | 7/2008 |
| JP | 2008-198407 | | 8/2008 |
| JP | 2009-91239 | | 4/2009 |
| JP | 2009-94074 | | 4/2009 |
| TW | 261789 | | 11/1995 |
| TW | 264599 | | 12/1995 |
| TW | 391482 | | 5/2000 |
| TW | I253898 | | 4/2006 |
| TW | 200800793 | | 1/2008 |
| TW | M326535 | | 2/2008 |
| TW | M334291 | | 6/2008 |
| TW | 200832453 | A | 8/2008 |
| TW | M346391 | | 12/2008 |
| TW | I341878 | | 7/2009 |
| WO | WO2008118486 | | 7/2007 |
| WO | WO2008133299 | | 11/2008 |

OTHER PUBLICATIONS

Zhu et al., The growth of carbon nanotube stacks in the kinetics controlled regime, Science Direct, (2006) pp. 344-348.

Zhang et al., "Metal coating on suspended carbon nanotubes and its implication to metal-tube interaction," Chemical physics letters 331 (2000), pp. 35-41.

Zhu et al., Aligned Carbon Nanotube Stacks by Water-Assisted Selective Etching, Nano Letters, (2005), pp. 2641-2645.

Klie et al. Multi-walled carbon nanotubes on amorphous carbon films, Carbon 42 (2004), pp. 1953-1957.

Xuesong et al., Bottom-up Growth of Carbon Nanotube Multilayers: Unprecedented Grow, Nano Letters (2005), pp. 1997-2000.

Jiang Kai-Li et al. "Continuous carbon nanotube yarns and their applications" Physics, Aug. 2003, vol. 32, No. 8, p. 506-510, Section 2, the second paragraph of Section 4, Figure 1f and Figure 3a may be relevant.

* cited by examiner

HEATER

CROSS-REFERENCE TO RELATED APPLICATIONS

This application claims all benefits accruing under 35 U.S.C. §119 from China Patent Application No. 200910106403.3, filed on Mar. 27, 2009 in the China Intellectual Property Office.

BACKGROUND

1. Technical Field

The present disclosure relates to heaters and, particularly, to a heater based on carbon nanotubes.

2. Description of Related Art

Heaters are configured for generating heat and play an important role in our daily life, production and research.

Referring to FIG. 13, a heater, according to a first prior art, is shown. The heater includes a quartz substrate 1; a heating wire 4; two electrodes 5; and two posts 2. The quartz substrate 1 defines a hole array 3, and the heating wire 4 runs through the hole array 3. The posts 2 are used to fix the electrodes 5 on the quartz substrate 1. The two ends of the heating wire 4 are electrically connected to the two electrodes 5. However, the heater includes only one heating element and can only operate in a fully on or off state.

Referring to FIG. 14, another heater 10, according to the prior art, is shown. The heater 10 includes a substrate 11; a plurality of supporters 12 located on the substrate 11; a plurality of heating elements 14, and each heating element 14 is located on the corresponding supporter 12 with an isolative layer 13 located therebetween. The plurality of heating elements 14 are electrically connected to a controller (not shown) via a conductive net 16. Each heating element 14 can be controlled by the controller to work independently. However, the heating elements 14 are relatively heavy because they are usually made of ceramics, conductive glasses or metals which have a relative high density.

What is needed, therefore, is a heater that can overcome the above-described shortcomings.

BRIEF DESCRIPTION OF THE DRAWINGS

Many aspects of the present heater can be better understood with reference to the following drawings. The components in the drawings are not necessarily drawn to scale, the emphasis instead being placed upon clearly illustrating the principles of the present heater.

Figure 1:
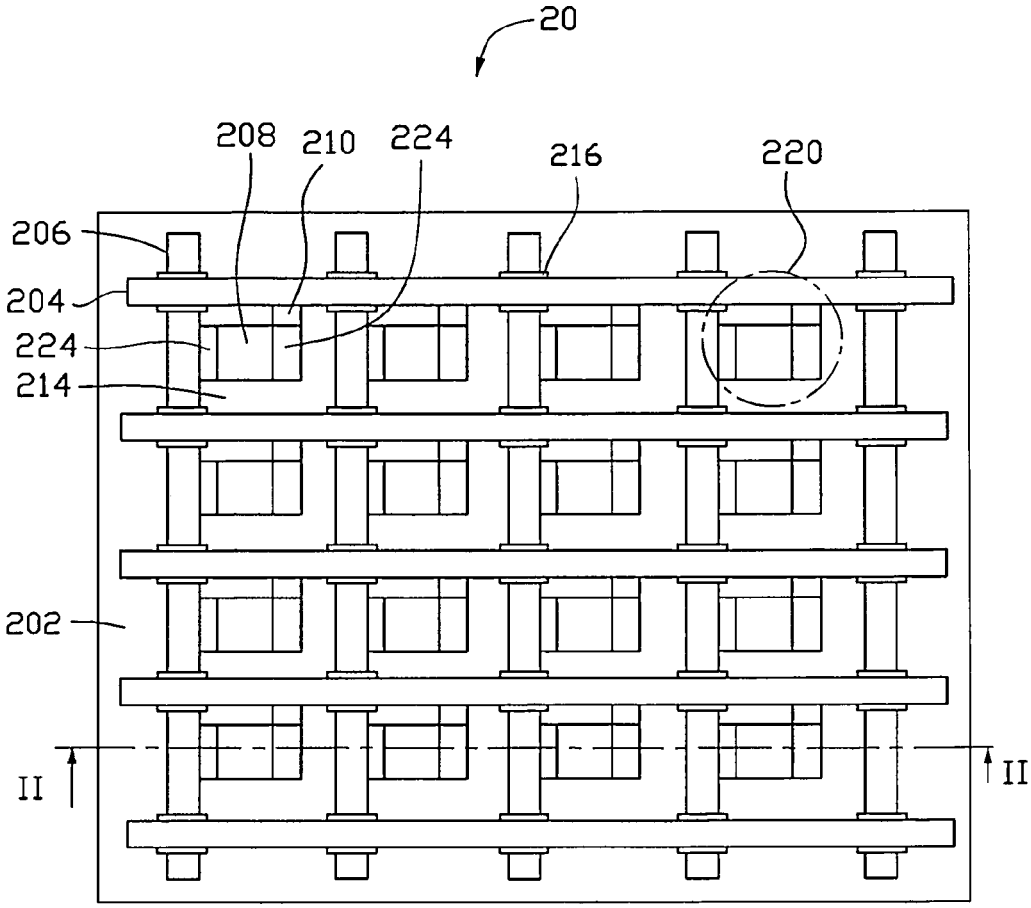
FIG. 1 is an isotropic view of a heater in accordance with one embodiment.

Corresponding reference characters indicate corresponding parts throughout the several views. The exemplifications set out herein illustrate at least one embodiment of the present heater, in at least one form, and such exemplifications are not to be construed as limiting the scope of the disclosure in any manner.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

References will now be made to the drawings to describe, in detail, various embodiments of the present heater.

Figure 2:
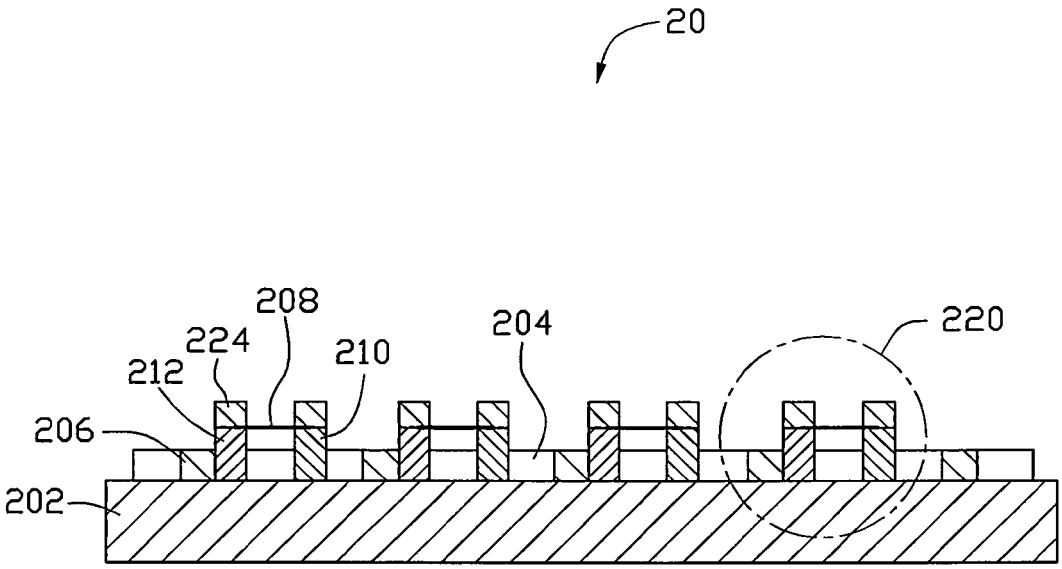
FIG. 2 is a schematic, cross-sectional view, along a line II-II of FIG. 1.

Referring to FIGS. 1 and 2, a heater 20 according to one embodiment is shown. The heater 20 includes a substrate 202, a plurality of first electrode down-leads 204, a plurality of second electrode down-leads 206 and a plurality of heating units 220. The first electrode down-leads 204 are located on the substrate 202 in parallel to each other. The second electrode down-leads 206 are located on the substrate 202 in parallel to each other. The first electrode down-leads 204 cross the second electrode down-leads 206. A plurality of grids 214 are defined by each two adjacent first electrode down-leads 204 and each two adjacent second electrode down-leads 206. One heating unit 220 is located in each grid 214.

The substrate 202 can be made of insulative material. The insulative material can be ceramics, glass, resins, quartz or combinations thereof. A size and a thickness of the substrate 202 can be chosen according to need. In one embodiment, the substrate 202 is a quartz substrate with a thickness of 1 mm (millimeter), an edge length of 48 mm, and the number of the heating units 220 is 16×16 (16 rows, 16 units 220 on each row).

The first electrode down-leads 204 can be located equidistantly. A distance between adjacent two first electrode down-leads 204 can range from about 50 μm (micrometer) to about 2 cm (centimeter). The second electrode down-leads 206 can be located equidistantly. A distance between adjacent two second electrode down-leads 206 can range from about 50 μm to about 2 cm. In one embodiment the first electrode down-leads 204 and the second electrode down-leads 206 are set at an angle with respect to each other. The angle can range from about 10 degrees to about 90 degrees. In one embodiment, the angle is about 90 degrees.

The first electrode down-leads 204 and the second electrode down-leads 206 are made of conductive material such as metal or a conductive slurry. In one embodiment, the first electrode down-leads 204 and the second electrode down-leads 206 are formed by applying conductive slurry on the substrate 202 using a printing process. The conductive slurry is composed of metal powder, glass powder, and binder. The metal powder can be silver powder, the glass powder has low melting point, and the binder can be terpineol or ethyl cellulose (EC). The conductive slurry can include from about 50% to about 90% (by weight) of the metal powder, from about 2% to about 10% (by weight) of the glass powder, and from about 8% to about 40% (by weight) of the binder. In one embodiment, each of the first electrode down-leads 204 and the second electrode down-leads 206 is formed with a width in a range from about 30 μm to about 100 μm and with a thickness in a range from about 10 μm to about 50 μm. However, it is noted that dimensions of each of the first electrode down-leads 204 and the second electrode down-leads 206 can vary corresponding to dimensions of each grid 214.

Furthermore, the heater 20 can include a plurality of insulators 216 sandwiched between the first electrode down-leads 204 and the second electrode down-leads 206 to avoid short-circuiting. The insulators 216 are located at every intersection of the first electrode down-leads 204 and the second electrode down-leads 206 and provide electrical insulation therebetween. In one embodiment, the insulator 216 is a dielectric insulator.

Each of the heating units 220 can include a first electrode 210, a second electrode 212, and a heating element 208. A distance between the first electrode 210 and the second electrode 212 can be in a range from about 10 μm to about 2 cm. The heating element 208 is located between and electrically connected to the first electrode 210 and the second electrode 212. The heating element 208 can be spaced from the substrate 202 to avoid the heat generated by the heating element 208 being absorbed by the substrate 202. A distance between the heating element 208 and the substrate 202 can be in a range from about 10 μm to about 2 cm. In one embodiment, the distance between the heating element 208 and the substrate 202 is about 1 mm.

The first electrodes 210 of the heating units 220 are electrically connected to the first electrode down-lead 204. The second electrodes 212 of the heating units 220 are electrically connected to the second electrode down-lead 206.

Each of the first electrodes 210 can have a length in a range from about 20 μm to about 15 mm, a width in a range from about 30 μm to 10 mm and a thickness in a range from about 10 μm to about 500 μm. Each of the second electrodes 212 has a length in a range from about 20 μm to about 15 mm, a width in a range from about 30 μm to about 10 mm and a thickness in a range from about 10 μm to about 500 μm. In one embodiment, the first electrode 210 has a length in a range from about 100 μm to about 700 μm, a width in a range from about 50 μm to about 500 μm and a thickness in a range from about 20 μm to about 100 μm. The second electrode 212 has a length in a range from about 100 μm to about 700 μm, a width in a range from about 50 μm to about 500 μm and a thickness in a range from about 20 μm to about 100 μm.

The first electrodes 210 and the second electrode 212 can be made of metal or conductive slurry. In one embodiment, the first electrode 210 and the second electrode 212 are formed by printing the conductive slurry on the substrate 202.

The heating element 208 includes a carbon nanotube structure. The carbon nanotube structure includes a plurality of carbon nanotubes uniformly distributed therein, and the carbon nanotubes therein can be combined by van der Waals attractive force therebetween. The carbon nanotube structure can be a substantially pure structure of the carbon nanotubes, with few impurities. The carbon nanotubes can be used to form many different structures and provide a large specific surface area. The heat capacity per unit area of the carbon nanotube structure can be less than $2\times10^{-4}$ J/m$^2$·K. In one embodiment, the heat capacity per unit area of the carbon nanotube structure is less than $1.7\times10^{-6}$ J/m$^2$·K. As the heat capacity of the carbon nanotube structure is very low, and the temperature of the heating element 208 can rise and fall quickly, which makes the heating element 208 have a high heating efficiency and accuracy. As the carbon nanotube structure can be substantially pure, the carbon nanotubes are not easily oxidized and the life of the heating element 208 will be relatively long. Further, the carbon nanotubes have a low density, about 1.35 g/cm$^3$, so the heating element 208 is light. As the heat capacity of the carbon nanotube structure is very low, the heating element 208 has a high response heating speed. As the carbon nanotube has large specific surface area, the carbon nanotube structure with a plurality of carbon nanotubes has large specific surface area. When the specific surface of the carbon nanotube structure is large enough, the carbon nanotube structure is adhesive and can be directly applied to a surface.

The carbon nanotubes in the carbon nanotube structure can be arranged orderly or disorderly. The term 'disordered carbon nanotube structure' includes, but is not limited to, to a structure where the carbon nanotubes are arranged along many different directions, and the aligning directions of the carbon nanotubes are random. The number of the carbon nanotubes arranged along each different direction can be almost the same (e.g. uniformly disordered). The disordered carbon nanotube structure can be isotropic. The carbon nanotubes in the disordered carbon nanotube structure can be entangled with each other.

The carbon nanotube structure including ordered carbon nanotubes is an ordered carbon nanotube structure. The term 'ordered carbon nanotube structure' includes, but is not limited to, to a structure where the carbon nanotubes are arranged in a consistently systematic manner, e.g., the carbon nanotubes are arranged approximately along a same direction and/or have two or more sections within each of which the carbon nanotubes are arranged approximately along a same direction (different sections can have different directions). The carbon nanotubes in the carbon nanotube structure can be selected from a group consisting of single-walled, double-walled, and/or multi-walled carbon nanotubes.

The carbon nanotube structure can be a carbon nanotube film structure with a thickness ranging from about 0.5 nm (nanometer) to about 1 mm. The carbon nanotube film structure can include at least one carbon nanotube film. The carbon nanotube structure can also be a linear carbon nanotube structure with a diameter ranging from about 0.5 nm to about 1 mm. The carbon nanotube structure can also be a combination of the carbon nanotube film structure and the linear carbon nanotube structure. It is understood that any carbon nanotube structure described can be used with all embodiments. It is also understood that any carbon nanotube structure may or may not employ the use of a support structure.

Figure 3:
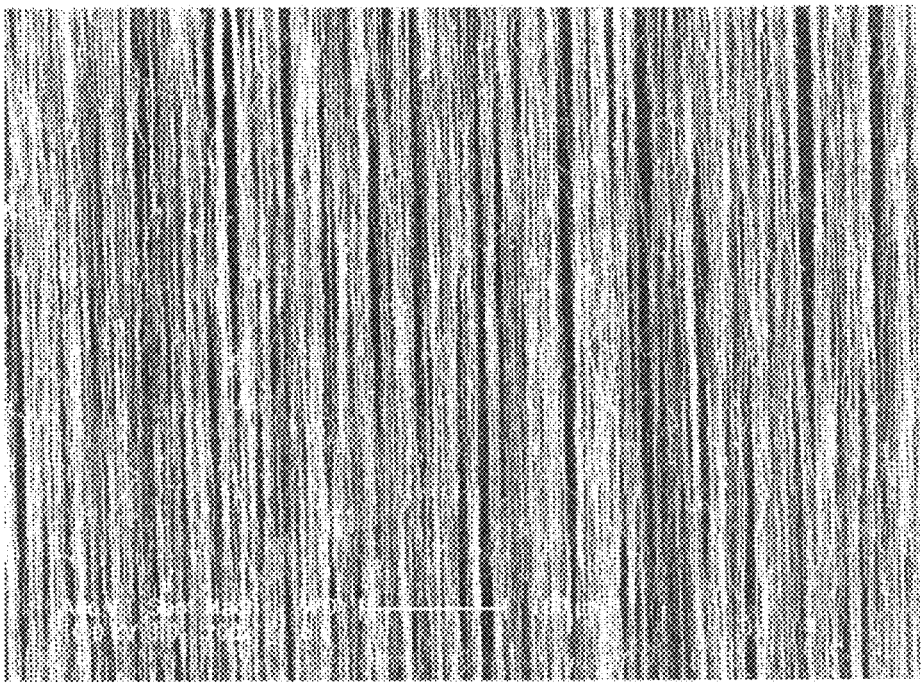
FIG. 3 is a Scanning Electron Microscope (SEM) image of a drawn carbon nanotube film.
Figure 4:
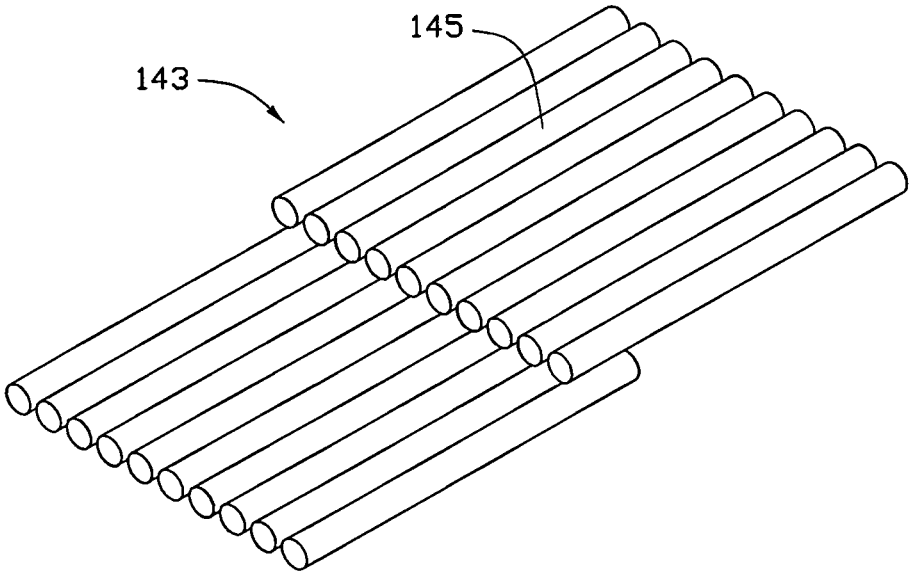
FIG. 4 is a schematic of a carbon nanotube segment in the drawn carbon nanotube film of FIG. 3.
Figure 7:
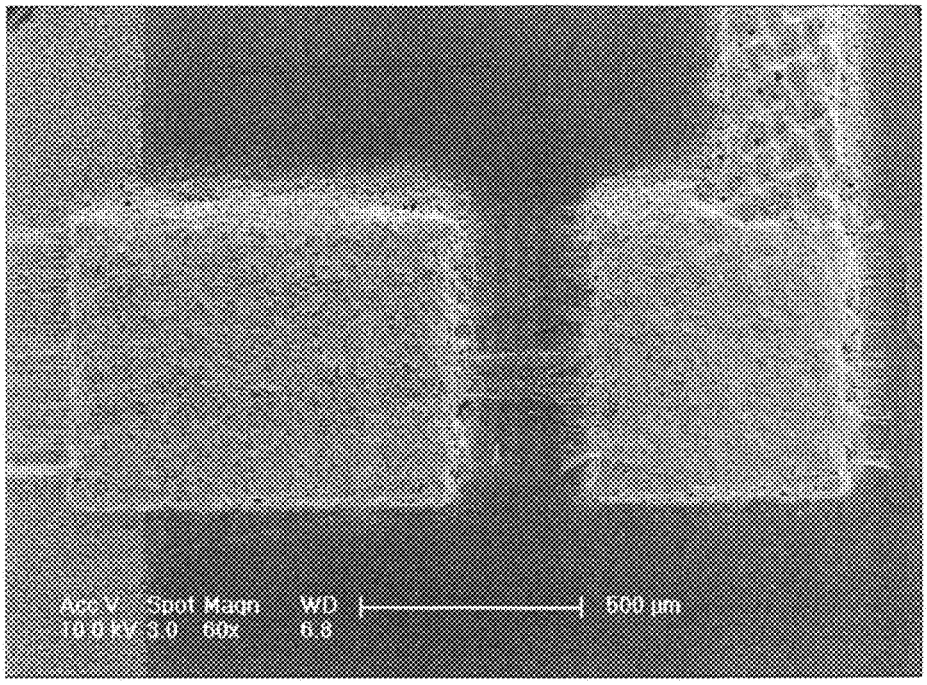
FIG. 7 is an SEM image from top of a heating element according to one embodiment.
Figure 8:
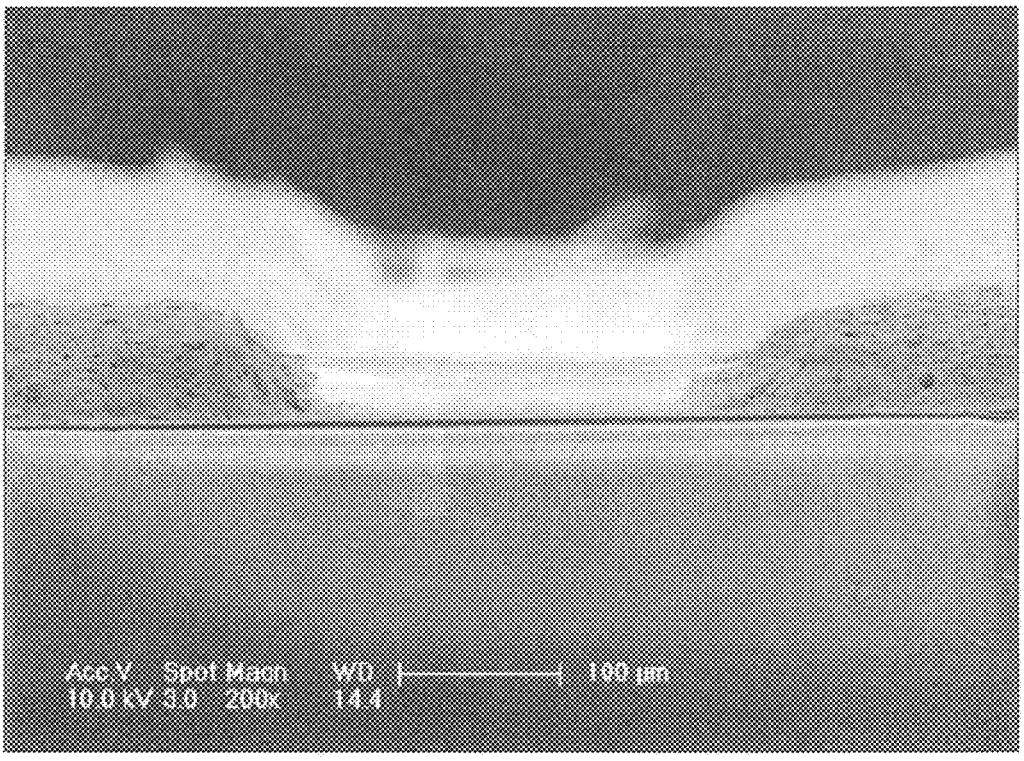
FIG. 8 is an SEM image from side of the heating element of FIG. 7.

In one embodiment, the carbon nanotube film structure includes at least one drawn carbon nanotube film. A drawn carbon nanotube film is be drawn from a carbon nanotube array that is able to have a film drawn therefrom. The drawn carbon nanotube film includes a plurality of successive and oriented carbon nanotubes joined end-to-end by van der Waals attractive force therebetween. The drawn carbon nanotube film is a free-standing film. Referring to FIGS. 3 to 4, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 3, some variations can occur in the drawn carbon nanotube film. The carbon nanotubes 145 in the drawn carbon nanotube film are oriented along a preferred orientation. The carbon nanotube film can be treated with an organic solvent to increase the mechanical strength and toughness and reduce the coefficient of friction of the carbon nanotube film. A thickness of the carbon nanotube film can range from about 0.5 nm to about 100 μm. Referring to FIGS. 7 and 8, in one embodiment, the heating element 208 is a drawn carbon nanotube film with a length of 300 μm and a width of 100 μm. The carbon nanotubes of the heating element 208 extends from the first electrode 210 to the second electrode 212. The drawn carbon nanotube film can be attached to surfaces of the electrode 210, 212 with an adhesive, by mechanical force, by the adhesive properties of the carbon nanotube film, or by a combination thereof.

The carbon nanotube film structure of the heating element 208 can include at least two stacked drawn carbon nanotube films. In other embodiments, the carbon nanotube structure can include two or more coplanar carbon nanotube films, and can include layers of coplanar carbon nanotube films. Additionally, when the carbon nanotubes in the carbon nanotube film are aligned along one preferred orientation (e.g., the drawn carbon nanotube film), an angle can exist between the orientation of carbon nanotubes in adjacent films, whether stacked or adjacent. Adjacent carbon nanotube films can be combined by only the van der Waals attractive force therebetween. The number of the layers of the carbon nanotube films is not limited as long as the carbon nanotube structure. However the thicker the carbon nanotube structure, the specific surface area will decrease. An angle between the aligned directions of the carbon nanotubes in two adjacent carbon nanotube films can range from about 0° to about 90°. When the angle between the aligned directions of the carbon nanotubes in adjacent stacked carbon nanotube films is larger than 0 degrees, a microporous structure is defined by the carbon nanotubes in the heating element 208. The carbon nanotube structure in an embodiment employing these films will have a plurality of micropores. Stacking the carbon nanotube films will also add to the structural integrity of the carbon nanotube structure. In some embodiments, the carbon nanotube structure is a free standing structure.

In another embodiment, the carbon nanotube film structure includes a flocculated carbon nanotube film. The flocculated carbon nanotube film can include a plurality of long, curved, disordered carbon nanotubes entangled with each other. Further, the flocculated carbon nanotube film can be isotropic. The carbon nanotubes can be substantially uniformly dispersed in the carbon nanotube film. Adjacent carbon nanotubes are acted upon by van der Waals attractive force to form an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure. Further, due to the carbon nanotubes in the carbon nanotube structure being entangled with each other, the carbon nanotube structure employing the flocculated carbon nanotube film has excellent durability, and can be fashioned into desired shapes with a low risk to the integrity of the carbon nanotube structure. The flocculated carbon nanotube film, in some embodiments, will not require the use of the planar supporter 18 due to the carbon nanotubes being entangled and adhered together by van der Waals attractive force therebetween. The thickness of the flocculated carbon nanotube film can range from about 0.5 nm to about 1 mm.

In another embodiment, the carbon nanotube film structure can include at least a pressed carbon nanotube film. The pressed carbon nanotube film can be a free-standing carbon nanotube film. The carbon nanotubes in the pressed carbon nanotube film are arranged along a same direction or arranged along different directions. The carbon nanotubes in the pressed carbon nanotube film can rest upon each other. Adjacent carbon nanotubes are attracted to each other and combined by van der Waals attractive force. An angle between a primary alignment direction of the carbon nanotubes and a surface of the pressed carbon nanotube film is 0 degrees to approximately 15 degrees. The greater the pressure applied, the smaller the angle formed. When the carbon nanotubes in the pressed carbon nanotube film are arranged along different directions, the carbon nanotube structure can be isotropic. The thickness of the pressed carbon nanotube film ranges from about 0.5 nm to about 1 mm.

Carbon nanotube structures include linear carbon nanotubes. In other embodiments, the linear carbon nanotube structures, including carbon nanotube wires and/or carbon nanotube cables, can be used.

Figure 5:
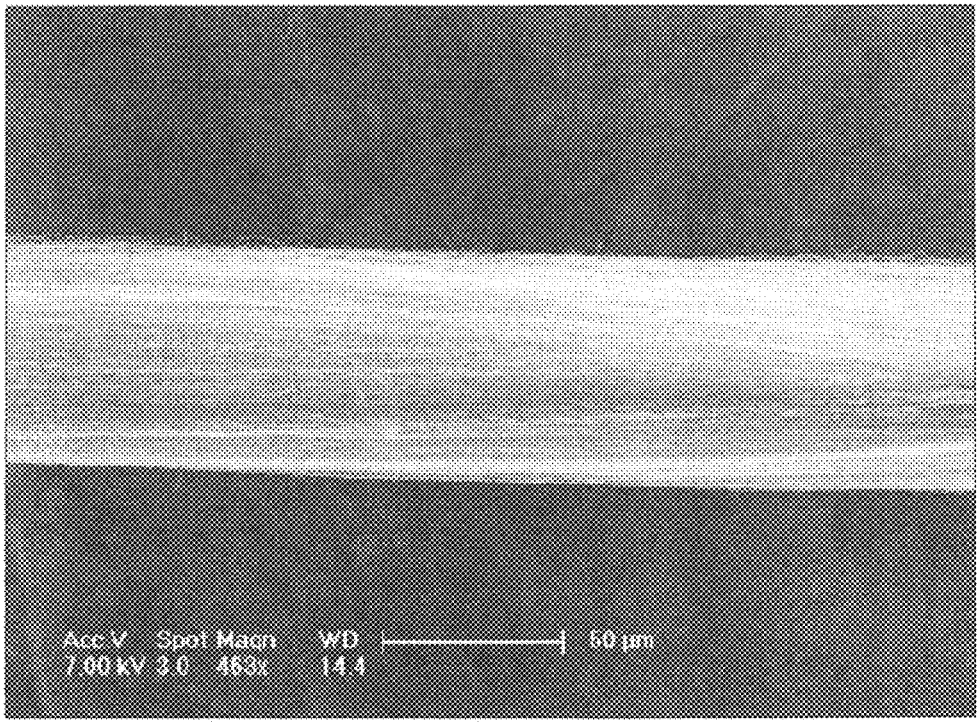
FIG. 5 is an SEM image of an untwisted carbon nanotube wire.

The carbon nanotube wire can be untwisted or twisted. Treating the drawn carbon nanotube film with a volatile organic solvent can form the untwisted carbon nanotube wire. Specifically, the organic solvent is applied to soak the entire surface of the drawn carbon nanotube film. During the soaking, adjacent parallel carbon nanotubes in the drawn carbon nanotube film will bundle together, due to the surface tension of the organic solvent as it volatilizes, and thus, the drawn carbon nanotube film will be shrunk into untwisted carbon nanotube wire. Referring to FIG. 5, the untwisted carbon nanotube wire includes a plurality of carbon nanotubes substantially oriented along a same direction (i.e., a direction along the length of the untwisted carbon nanotube wire). The carbon nanotubes are parallel to the axis of the untwisted carbon nanotube wire. More specifically, the untwisted carbon nanotube wire includes a plurality of successive carbon nanotube segments joined end to end by van der Waals attractive force therebetween. Each carbon nanotube segment includes a plurality of carbon nanotubes substantially parallel to each other, and combined by van der Waals attractive force therebetween. The carbon nanotube segments can vary in width, thickness, uniformity and shape. Length of the untwisted carbon nanotube wire can be arbitrarily set as desired. A diameter of the untwisted carbon nanotube wire ranges from about 0.5 nm to about 100 μm.

Figure 6:
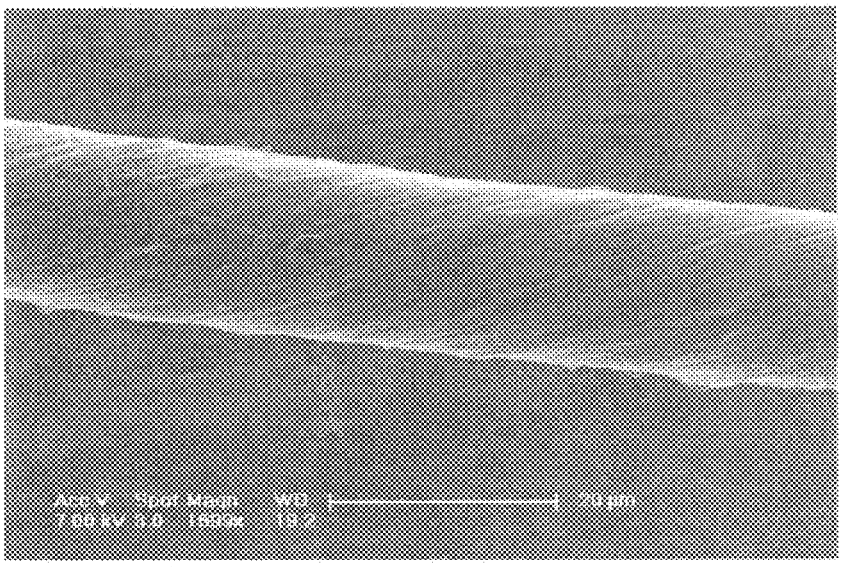
FIG. 6 is an SEM image of a twisted carbon nanotube wire.

The twisted carbon nanotube wire can be formed by twisting a drawn carbon nanotube film using a mechanical force to turn the two ends of the drawn carbon nanotube film in opposite directions. Referring to FIG. 6, the twisted carbon nanotube wire includes a plurality of carbon nanotubes helically oriented around an axial direction of the twisted carbon nanotube wire. More specifically, the twisted carbon nanotube wire includes a plurality of successive carbon nanotube segments joined end to end by van der Waals attractive force therebetween. Each carbon nanotube segment includes a plurality of carbon nanotubes parallel to each other, and combined by van der Waals attractive force therebetween. Length of the carbon nanotube wire can be set as desired. A diameter of the twisted carbon nanotube wire can be from about 0.5 nm to about 100 μm. Further, the twisted carbon nanotube wire can be treated with a volatile organic solvent after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease, while the density and strength of the twisted carbon nanotube wire will be increased.

The carbon nanotube cable includes two or more carbon nanotube wires. The carbon nanotube wires in the carbon nanotube cable can be, twisted or untwisted. In an untwisted carbon nanotube cable, the carbon nanotube wires are parallel with each other. In a twisted carbon nanotube cable, the carbon nanotube wires are twisted with each other.

The heating element 208 can include one or more linear carbon nanotube structures. The plurality of linear carbon nanotube structures can be paralleled with each other, cross with each other, weaved together, or twisted with each other. The resulting structure can be a planar structure if so desired.

In other embodiments, the carbon nanotube structure can include other materials thus becoming carbon nanotube composite. The carbon nanotube composite can include a carbon nanotube structure and a plurality of fillers dispersed therein. The filler can be comprised of a material selected from a group consisting of metal, ceramic, glass, carbon fiber and combinations thereof. Alternatively, the carbon nanotube composite can include a matrix and a plurality of carbon nanotubes dispersed therein. The matrix can be comprised of a material selected from a group consisting of resin, metal, ceramic, glass, carbon fiber and combinations thereof. In one embodiment, a carbon nanotube structure is packaged in a resin matrix.

Furthermore, the heater 20 can include a fixing element 224 located on the first electrode 210 and the second electrode 212. The fixing element 224 is configured to fix the heating element 208 on the first electrode 210 and the second electrode 212. In one embodiment, the material, shape, and/or size of the fixing element 224 is the same as the second electrode 212.

Furthermore, a heat-reflecting layer (not shown) can be located on a surface of the substrate 202. The heat-reflecting layer is located between the substrate 202 and the heating element 208. The heat-reflecting layer may be made of insulative materials. The material of the heat-reflecting layer can be metal oxides, metal salts, or ceramics. In one embodiment, the heat-reflecting layer is an aluminum oxide ($Al_2O_3$) film. A thickness of the heat-reflecting layer can be in a range from about 100 μm to about 0.5 mm. In one embodiment, the thickness of the heat-reflecting layer is 0.1 mm. The heat-reflecting layer is configured for reflecting the heat emitted by the heating element 208, and to control the direction of travel of the heat from the heating element 208 for single-side heating. The heat-reflecting layer is an optional structure and can be omitted.

Furthermore, a protecting layer (not shown) can be located on a surface of the substrate 202 to cover the electrode down-leads 204, 206, the electrodes 210, 212 and the heating elements 208. The material of protecting layer can be electric or insulative. The electric material can be metal or alloy. The insulative material can be resin, plastic or rubber. A thickness of the protecting layer can range from about 0.5 μm to about 2 mm. When the material of the protecting layer is insulative, the protecting layer can electrically and/or thermally insulate the heater 20 from the external environment. The protecting layer can also protect the heating element 208 from outside contaminants. The protecting layer is an optional structure and can be omitted.

In use, a driving circuit (not shown) can be included. Each heating element 208 of the heater 20 can be controlled by the driving circuit to heat independently.

Figure 9:
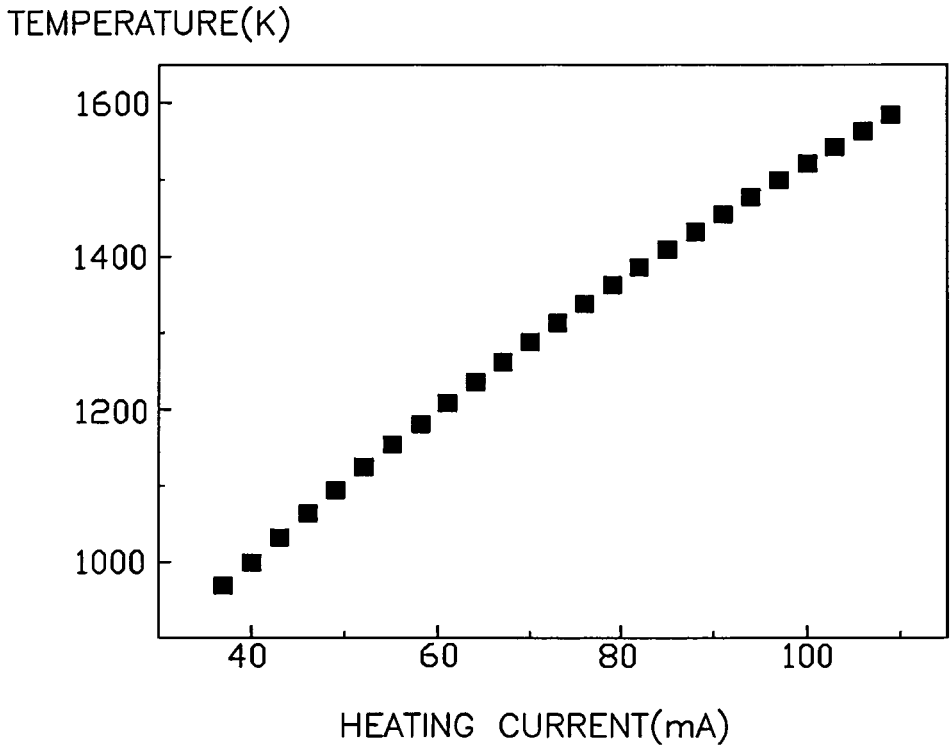
FIG. 9 is a heating current-temperature curve of one embodiment.
Figure 10:
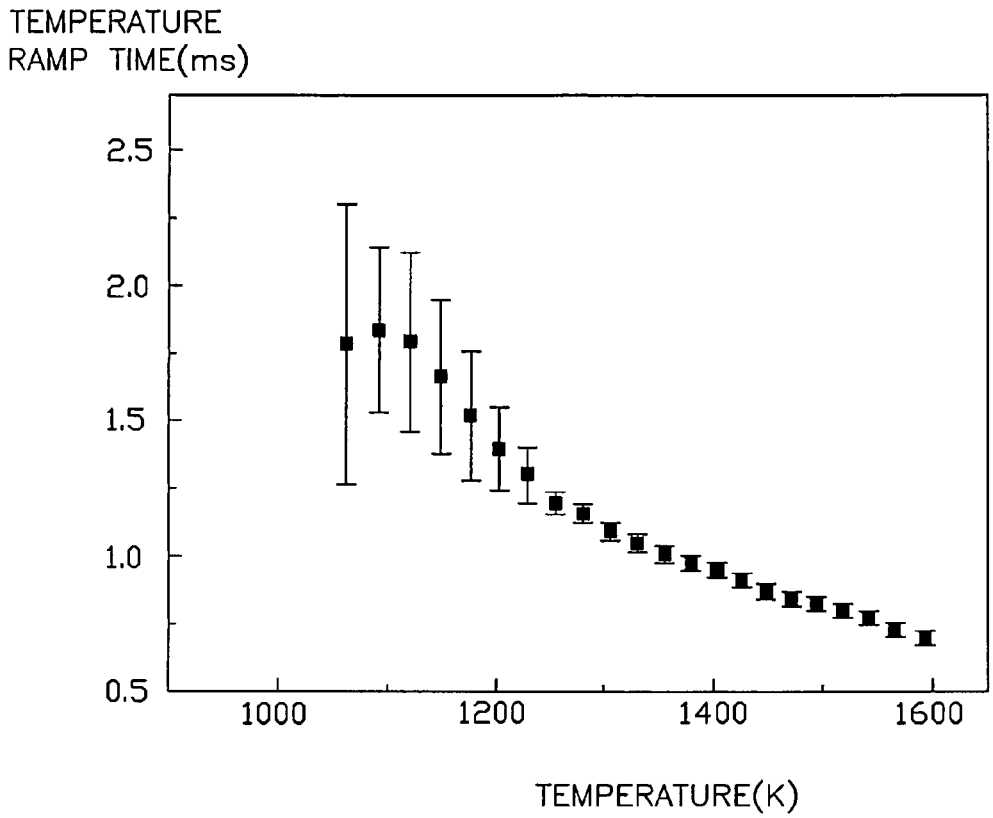
FIG. 10 is a temperature-temperature ramp time curve of one embodiment.

The heater 20 has a high heating efficiency due to the high thermal radiation efficiency of the carbon nanotubes. In one tested embodiment, the heating element 208 is a drawn carbon nanotube film with a length of 8 mm and a width of 2.5 mm and the results are shown in FIGS. 9 and 10. Referring to FIG. 9, when the current is about 100 mA (milliampere), the temperature of the heating element 208 can be about 1600 K. The heating element 208 has a high response heating speed due to the very low heat capacity per unit area of the carbon nanotube structure. Referring to FIG. 10, the temperature ramp time decreases as the heating temperature of the heating element 208 increases.

Figure 11:
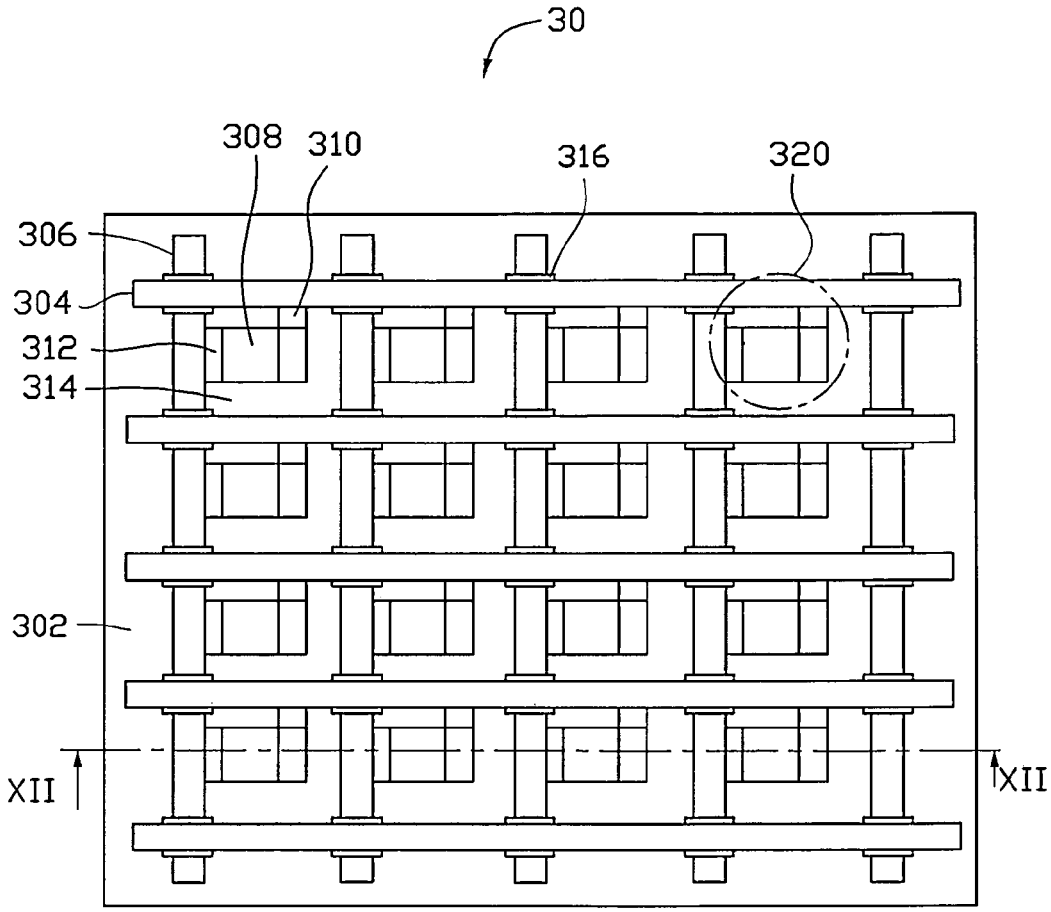
FIG. 11 is an isotropic view of a heater according to another embodiment.
Figure 12:
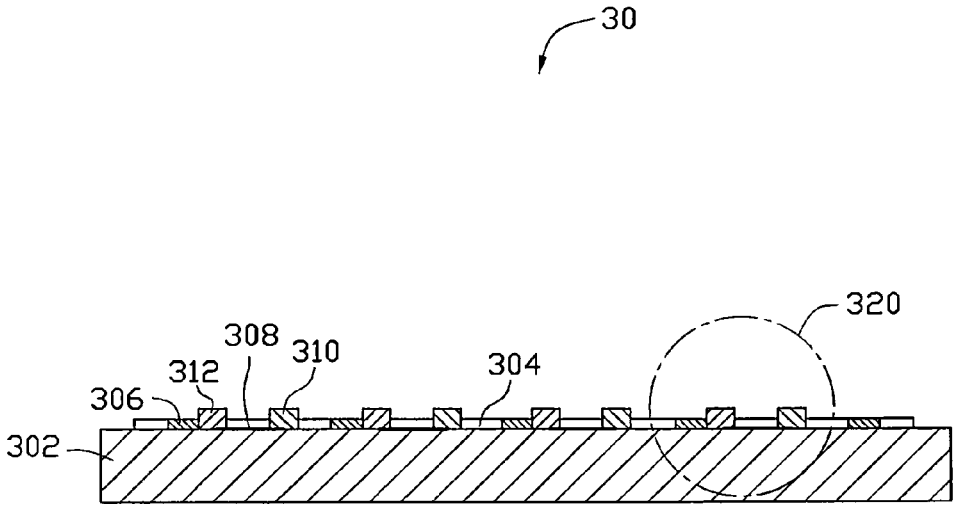
FIG. 12 is a schematic, cross-sectional view, along a line XII-XII of FIG. 11.
Figure 13:
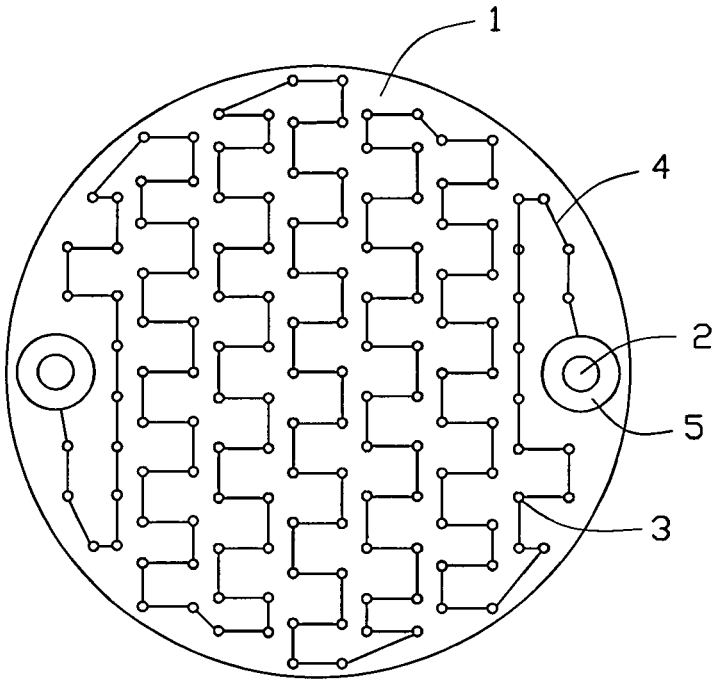
FIG. 13 (PRIOR ART)
FIG. 13 is an isotropic view of a heater in accordance with the prior art.
Figure 14:
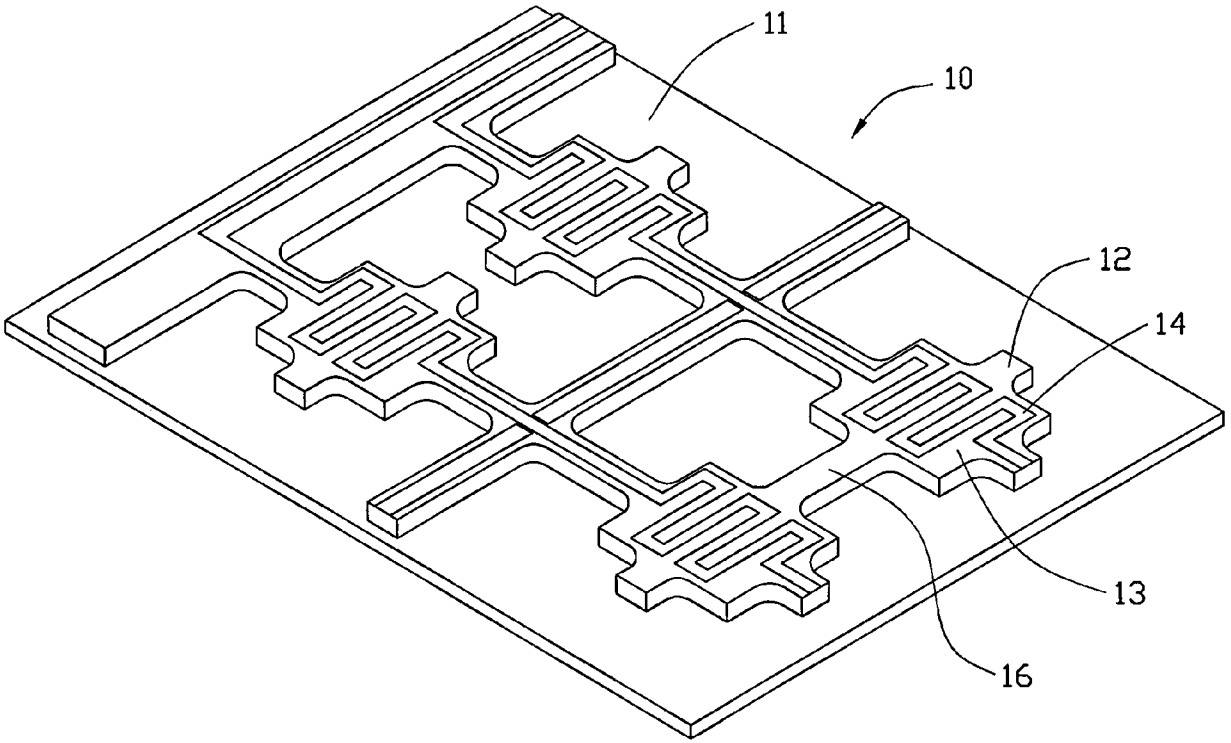
FIG. 14 (PRIOR ART)
FIG. 14 is an isotropic view of another heater in accordance the prior art.

Referring to FIGS. 11 and 12, a heater 30 according to one embodiment is shown. The heater 30 includes a substrate 302, a plurality of first electrode down-leads 304, a plurality of second electrode down-leads 306 and a plurality of heating units 320. One heating unit 320 is located in each grid 314 defined by the first electrode down-leads 304 and the second electrode down-leads 306. Each heating unit 320 includes a first electrode 310, a second electrode 312 and a heating element 308. The heater 30 has a similar structure as the heater 20 discussed in previous embodiments and the heating element 308 is located on and contacts with the substrate 302. The heating element 308 can includes a carbon nanotube structure provided in previous embodiments or include a carbon nanotube structure formed by printing.

The heaters 20, 30 have a plurality of advantages including the following. Firstly, the heaters 20, 30 have a high heating efficiency due to the high thermal radiation efficiency of the carbon nanotubes. Secondly, the heaters 20, 30 have a high response heating speed due to the very low heat capacity per unit area of the carbon nanotube structure. Thirdly, the heaters 20, 30 have are light and portable due to the relative low density of the carbon nanotubes. The heaters 20, 30 can be used in electric heaters, infrared therapy devices, electric radiators, and other related devices.

Finally, it is to be understood that the above-described embodiments are intended to illustrate rather than limit the disclosure. Variations may be made to the embodiments without departing from the spirit of the disclosure as claimed. The above-described embodiments illustrate the scope of the disclosure but do not restrict the scope of the disclosure.

What is claimed is:

1. A heater, comprising:

a substrate;

a plurality of first electrode down-leads; a plurality of second electrode down-leads; and the plurality of first electrode down-leads and the plurality of second electrode down-leads define a plurality of grids;

at least one grid comprises a heating unit; and the heating unit comprises a first electrode, a second electrode, and a heating element;

wherein the first electrode and the second electrode are electrically connected to the heating element and the heating element comprises a carbon nanotube structure; the carbon nanotube structure continuously extends from the first electrode to the second electrode so that an electric current is capable of flowing from the first electrode to the second electrode through the carbon nanotube structure; and the plurality of first electrode down-leads are insulated from each other, the plurality of second electrode down-leads are insulated from each other, and the heating unit are controlled and selected only by one of the plurality of first electrode down-leads and one of the plurality of second electrode down-leads.

2. The heater of claim 1, wherein an angle between an orientation of the plurality of first electrode down-leads and an orientation of the plurality of second electrode down-leads is about 90 degrees.

3. The heater of claim 1, wherein a heat capacity per unit area of the carbon nanotube structure is less than $2\times10^{-4}$ $J/m^2\cdot K$.

4. The heater of claim 1, wherein the carbon nanotube structure comprises a carbon nanotube film structure, a linear carbon nanotube structure or combinations thereof.

5. The heater of claim 4, wherein the carbon nanotube film structure comprises a plurality of carbon nanotubes substantially oriented along a same direction, and the same direction extends from the first electrode to the second electrode.

6. The heater of claim 5, wherein the carbon nanotubes of the carbon nanotube film structure are joined end-to-end by Van der Waals attractive force therebetween.

7. The heater of claim 4, wherein the carbon nanotube film structure comprises a plurality of carbon nanotubes entangled with each other.

8. The heater of claim 4, wherein the carbon nanotube film structure comprises a plurality of carbon nanotubes resting upon each other, an angle between an alignment direction of the carbon nanotubes and a surface of the heating element ranges from about 0 degrees to about 15 degrees.

9. The heater of claim 4, wherein the linear carbon nanotube structure comprises at least one untwisted carbon nanotube wire, at least one twisted carbon nanotube wire or combinations thereof.

10. The heater of claim 9, wherein the untwisted carbon nanotube wire comprises a plurality of carbon nanotubes substantially oriented along a direction of an axis of the untwisted carbon nanotube wire.

11. The heater of claim 9, wherein the twisted carbon nanotube wire comprises a plurality of carbon nanotubes helically oriented around an axis of the twisted carbon nanotube wire.

12. The heater of claim 1, wherein the heating element is spaced from the substrate.

13. The heater of claim 1, wherein the heating unit comprises a first fixing element and a second fixing element, a first portion of the carbon nanotube structure is sandwiched between the first fixing element and the first electrode, and a second portion of the carbon nanotube structure is sandwiched between the second fixing element and the second electrode.

14. The heater of claim 1, wherein the carbon nanotube structure is a pure structure consisting of a plurality of carbon nanotubes.

15. The heater of claim 1, wherein the plurality of first electrode down-leads, the plurality of second electrode down-leads, and the first electrode and the second electrode are made of conductive slurry.

16. A heater, comprising:

a substrate;

a plurality of first electrode down-leads and a plurality of second electrode down-leads located on the substrate, the plurality of first electrode down-leads cross the plurality of second electrode down-leads and corporately define a plurality of grids; and a plurality of heating units located corresponding to the plurality of grids, each heating unit comprises a first electrode, a second electrode, and a heating element, wherein the heating element comprises a plurality of carbon nanotubes, the heating element continuously extends from the first electrode to the second electrode so that an electric current is capable of flowing from the first electrode to the second electrode through the heating element; and the plurality of first electrode down-leads are insulated from each other, the plurality of second electrode down-leads are insulated from each other, and the heating unit are controlled and selected only by one of the plurality of first electrode down-leads and one of the plurality of second electrode down-leads.

* * * * *